US005992986A

United States Patent [19]

Gyotoku et al.

[11] Patent Number: 5,992,986

[45] Date of Patent: Nov. 30, 1999

[54] INK SUPPLY APPARATUS

[75] Inventors: Cliff Gyotoku; David Albertalli, both of San Jose; Jim Middleton, Brentwood; Peter Fellingham, San Jose, all of Calif.

[73] Assignee: Raster Graphics, Inc., San Jose, Calif.

[21] Appl. No.: 08/815,132

[22] Filed: Mar. 12, 1997

[51] Int. Cl.[6] ..... B41J 2/175

[52] U.S. Cl. ..... 347/85; 347/7

[58] Field of Search ..... 347/43, 49, 19, 347/35, 40, 85, 86, 87, 84, 7; 141/35, 234

[56] References Cited

U.S. PATENT DOCUMENTS

| | | | |
|---|---|---|---|
| 3,745,243 | 7/1973 | Seitz | 347/40 |
| 4,558,326 | 12/1985 | Kimura et al. | 347/35 |
| 4,604,654 | 8/1986 | Sakurada et al. | 347/43 |
| 4,677,448 | 6/1987 | Mizusawa et al. | 347/85 |
| 5,121,130 | 6/1992 | Hempel et al. | 347/89 |
| 5,159,348 | 10/1992 | Dietl et al. | 347/85 |
| 5,231,424 | 7/1993 | Kaneko et al. | 347/89 |
| 5,245,361 | 9/1993 | Kashimura et al. | 347/87 |
| 5,367,328 | 11/1994 | Erickson | 347/85 |

FOREIGN PATENT DOCUMENTS

| | | | |
|---|---|---|---|
| 327925 | 4/1930 | United Kingdom | 141/234 |

*Primary Examiner*—John Barlow
*Assistant Examiner*—Judy Nguyen
*Attorney, Agent, or Firm*—Burns, Doane, Swecker & Mathis LLP

[57] ABSTRACT

An ink supply apparatus includes a carriage on which a printer head arrangement including a printer head is mounted to an alignment plate and an ink reservoir arrangement including an ink reservoir is mounted to a frame pivotably connected to the alignment plate to permit access to the printer head arrangement. A conduit connects an inlet of the printer head to an outlet of the ink reservoir. The outlet of the ink reservoir is located directly behind the inlet of the printer head when the frame is pivoted to a normal operating position to minimize surges in the conduit and thereby prevent leakage out of or air ingestion into the nozzles of the printer head. The ink supply apparatus is particularly well suited for use in ink jet printers where multiple printer heads are used and printing occurs in two directions of travel of the carriage.

24 Claims, 7 Drawing Sheets

INK SUPPLY APPARATUS

BACKGROUND OF THE INVENTION

Field of the Invention

The present invention relates to an ink supply apparatus and, more particularly, to an ink supply apparatus including a reservoir for an ink jet printer apparatus.

BACKGROUND AND SUMMARY OF THE INVENTION

Well known desk top-type ink jet printing apparatus perform a printing operation on a single sheet of, for example, 8½"×11" paper. A printer carriage carrying one or more printer heads is moved laterally across the sheet of paper left-to-right and right-to-left and, on one of the lateral movements, an ink jet is laid down on the paper. The paper advances incrementally, usually by means of a pair of driven rollers, after each back and forth movement of the carriage and another ink jet is laid down. In color printing, usually between four and six different colors are laid down over an area by successive heads in successive sweeps across the paper. In such apparatus, because of the small size of the paper, the speed of the operation is not generally crucial. When ink runs out, the carriage must be stopped to reload a new ink reservoir or cartridge.

The present invention is particularly well-suited for use with substantially more sophisticated ink jet printers than desk top models, although it is not limited to use with such printers. With these ink jet printers, it is desirable to produce extremely high quality images on wide webs of paper and at very fast printing rates. The requirements of these apparatus in terms of accuracy of paper feed, methods of paper feed, and print head to paper distance are much higher than in conventional ink jet printers and pose problems not encountered in conventional printers.

In ink jet printers, a printer head typically has numerous small nozzles for spraying very fine ink sprays at specific times. Ink is provided to the printer head from a reservoir. To enhance printer speed and print quality, the present invention provides multiple print head arrangements each corresponding to a different color, such as the common cyan, magenta, yellow, and black, and each comprising multiple print heads for those colors precision mounted relative to one another on an alignment plate such that a unit area is printed in the desired colors numerous times by the numerous print heads, thereby enhancing the quality of the image created. The print head arrangements are preferably mounted on a movable carriage that moves laterally back and forth, i.e., left and right, across the web onto which the ink is to be printed, and the print heads preferably print both when the carriage is moving to the left and when the carriage is moving to the right. The present invention permits refilling the ink reservoirs while the carriage on which they are mounted is in motion and printing is occurring.

According to an embodiment of the present invention, an apparatus for supplying ink to a printer head arrangement mounted on a movable carriage is disclosed. The apparatus includes a track extending along a first axis, and a carriage mounted on the track and movable along the track in a positive and negative direction along the first axis. The apparatus further includes a printer head arrangement mounted on the movable carriage. The printer head arrangement includes one or more printer heads, each printer head of the one or more printer heads including an inlet and at least one nozzle. The apparatus further includes an ink reservoir arrangement mounted on the movable carriage behind the printer head arrangement. The ink reservoir arrangement includes one or more ink reservoirs, each ink reservoir of the one or more ink reservoirs having an outlet. One or more conduits are provided and connect the outlet of each of the one or more ink reservoirs to the inlet of a corresponding one of the one or more printer heads. The outlet of each ink reservoir and the inlet of the corresponding printer head are disposed along a second axis extending perpendicular to the first axis.

According to another aspect of the present invention, an ink reservoir arrangement is disclosed. The ink reservoir arrangement includes a first ink reservoir having a bottom wall and a side wall. The side wall of the first ink reservoir has an opening therein. The bottom wall of the first ink reservoir has an ink outlet opening therein. The ink reservoir arrangement further includes a second ink reservoir having a bottom wall and a side wall. The bottom wall of the second ink reservoir has an ink outlet opening therein. The opening in the side wall of the first ink reservoir permits fluid flow from the first ink reservoir to the second ink reservoir.

According to still another aspect of the present invention, a carriage for an ink jet printer arrangement is disclosed. The carriage includes a plate and a frame pivotably mounted to the plate. A printer head arrangement is mounted on the plate. The printer head arrangement includes one or more printer heads. Each printer head of the one or more printer heads includes an inlet and at least one nozzle. An ink reservoir arrangement is mounted on the frame. The ink reservoir arrangement includes one or more ink reservoirs. Each ink reservoir of the one or more ink reservoirs has an outlet. One or more conduits are provided and connect the outlet of each of the one or more ink reservoirs to the inlet of a corresponding one of the one or more printer heads.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
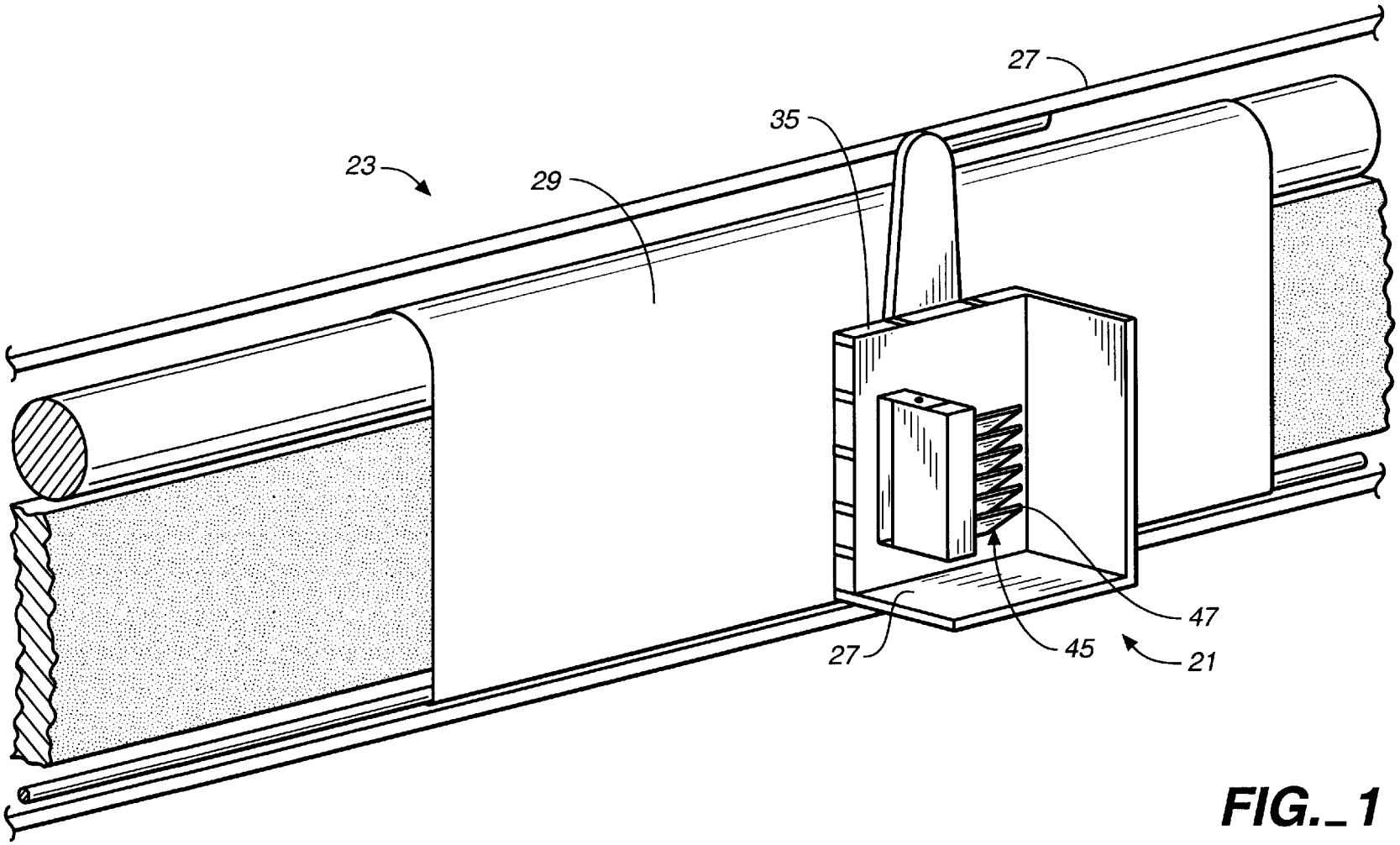
FIG. 1 schematically shows in perspective a portion of an ink jet printer apparatus according to an embodiment of the present invention.
Figure 2:
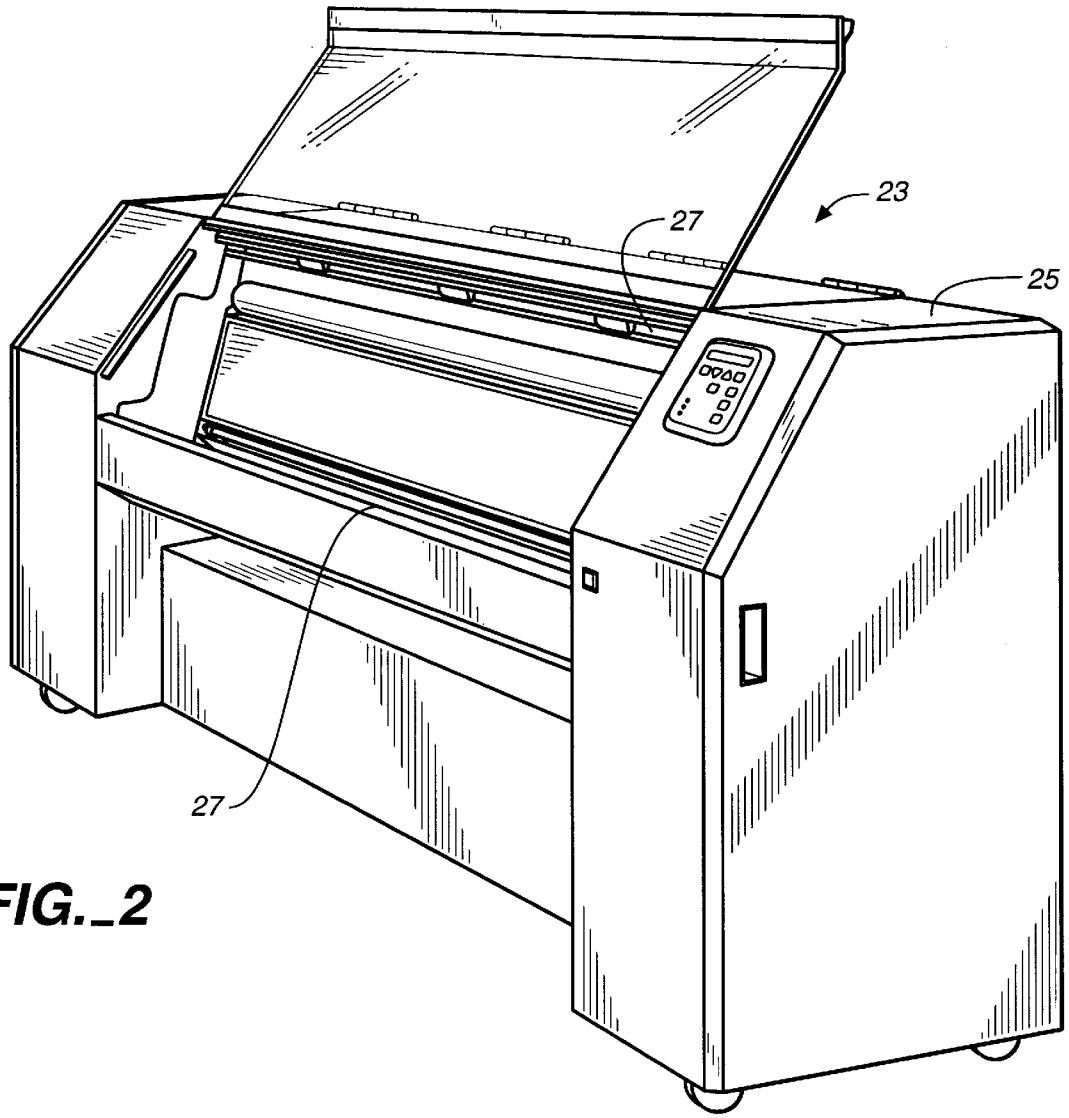
FIG. 2 is a perspective view of an ink jet printer apparatus according to an embodiment of the present invention.

A printer head carriage 21 according to an embodiment of the present invention is shown in FIG. 1. The printer head carriage 21 is preferably used in an ink jet printing apparatus 23, portions of which are seen in FIG. 1 and which is seen in its entirety in FIG. 2. The printer head carriage 21 is movably mounted relative to a frame 25 of the apparatus 23 along a substantially horizontal track 27. The printer head carriage 21 is moved horizontally back and forth along the track 27 relative to a web 29 of paper upon which it is desired to print by a suitable driving device, such as by a hydraulic or pneumatic driver or a chain or belt and driven sprocket arrangement, and a sensor monitors the location of the carriage.

The web 29 is preferably intermittently moved relative to the printer head carriage 21, preferably after each back and forth motion of the printer head carriage. A preferred intermittent movement apparatus for the web 29 is disclosed in commonly-assigned U.S. patent application Ser. No. 08/815,133, now U.S. Pat. No. 5,825,374 entitled Apparatus and Method for Intermittently Advancing a Web, the disclosure of which is incorporated by reference. The web is preferably held very flat against a large flat surface, preferably a vacuum platen. A method and apparatus for making a vacuum platen suitable for use in connection with the present invention is disclosed in commonly-assigned U.S. patent application Ser. No. 08/815,129, now U.S. Pat. No. 5,840,145 entitled Method for Reinforcing a Flexible Sheet, which is incorporated by reference.

The printer head carriage 21 is preferably adapted to print any number, preferably four or six, different color inks. When printing four ink colors, the ink colors are preferably cyan, magenta, yellow, and black. When printing six ink colors, the ink colors are preferably cyan, magenta, yellow, black, and two low concentration primary colors for improved print density control or premixed spot colors. For ease of discussion, the following description of a preferred embodiment of the invention will focus on printing of a single ink color, except where otherwise noted, because the equipment for printing any of the ink colors is substantially the same.

Figure 3:
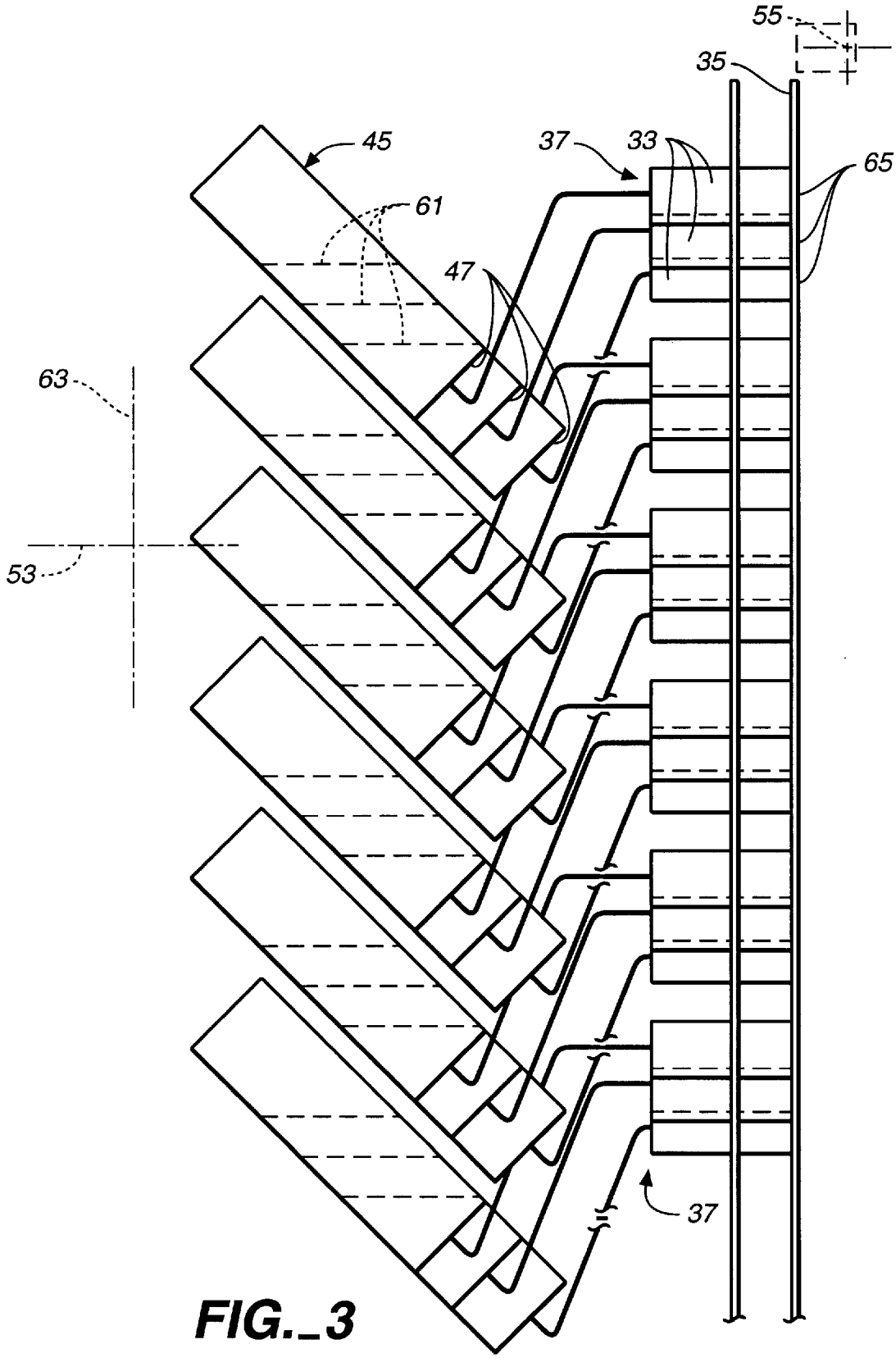
FIG. 3 is a schematic side view of a printer head carriage according to an embodiment of the present invention.
Figure 4:
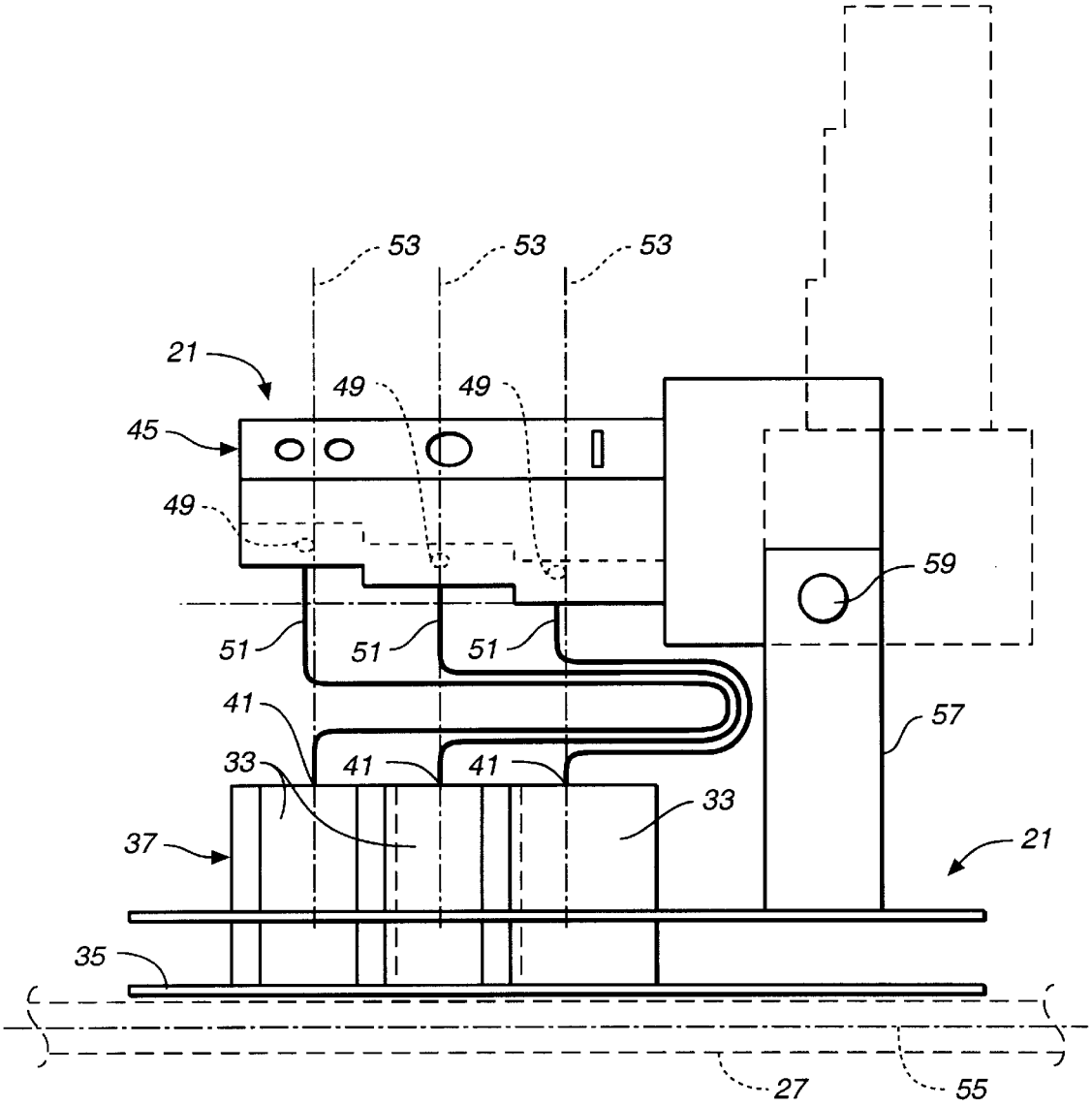
FIG. 4 is a schematic top plan view of a printer head carriage according to an embodiment of the present invention.
Figure 5:
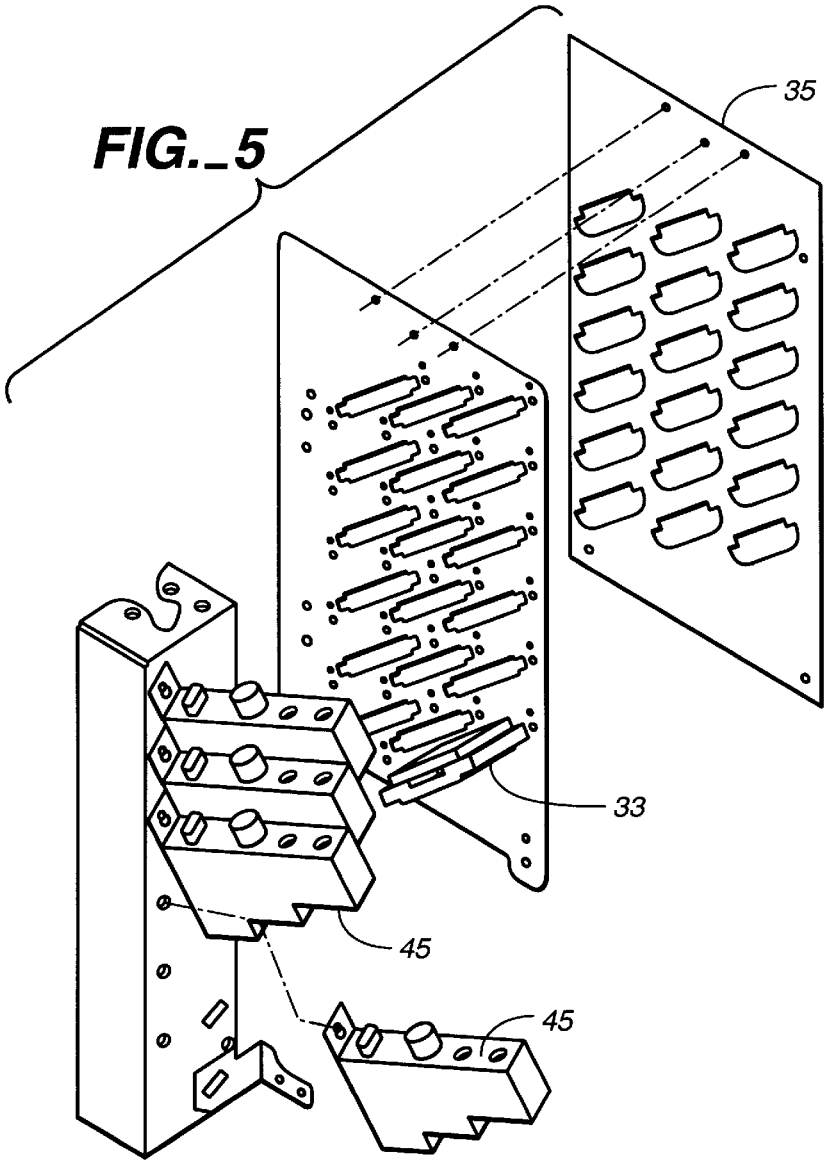
FIG. 5 is an exploded perspective view of portions of a printer head carriage according to an embodiment of the present invention.
Figure 6B:
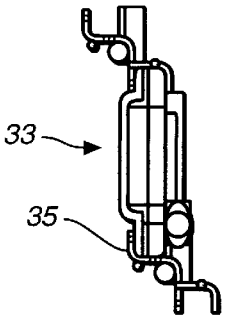
FIG. 6A is a side view of a portion of a printer head carriage showing a printer head mounted to an alignment plate and FIG. 6B is a top view taken along section 6B—6B of FIG. 6A.
Figure 6A:
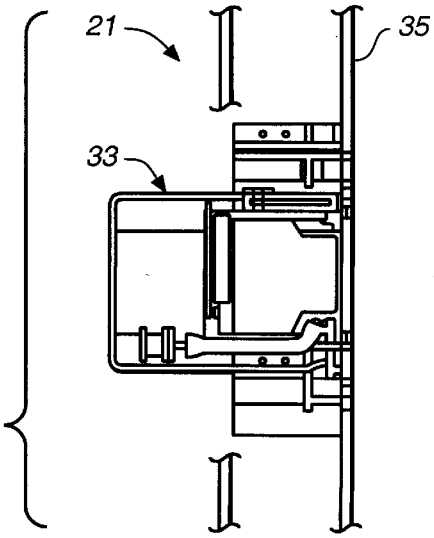

As seen in FIGS. 3–4, for each color, the printer head carriage 21 preferably includes a plurality of printer heads 33 precision mounted on an alignment plate 35 of the printer head carriage. Alignment plates are seen in FIGS. 5, 6A, and 6B. For each color there are preferably three such printer heads 33 defining a printer head arrangement 37. For each other color, another printer head arrangement 37 having a plurality, preferably three, printer heads 33 is provided. A suitable printer head mounting arrangement and method for precision mounting printer heads on an alignment plate and the structure of such an arrangement is disclosed in commonly-assigned U.S. Pat. No. 5,782,184, entitled Printer Head Carriage and Method for Aligning Printer Heads on a Printer Head Carriage, and a method of making a printer head carriage having an alignment plate suitable for use in connection with the present application is disclosed in commonly-assigned U.S. patent application Ser. No. 08/815,129, now U.S. Pat No. 5,840,145 entitled Method for Reinforcing a Flexible Sheet, the disclosures of which are incorporated by reference. Desirable features of the printer head carriage 21 include that the surface of the alignment plate 35 be very flat, and that the printer heads be in precise locations relative to one another and have nozzle surfaces that are flush with the flat outer surface of the alignment plate.

Figure 7:
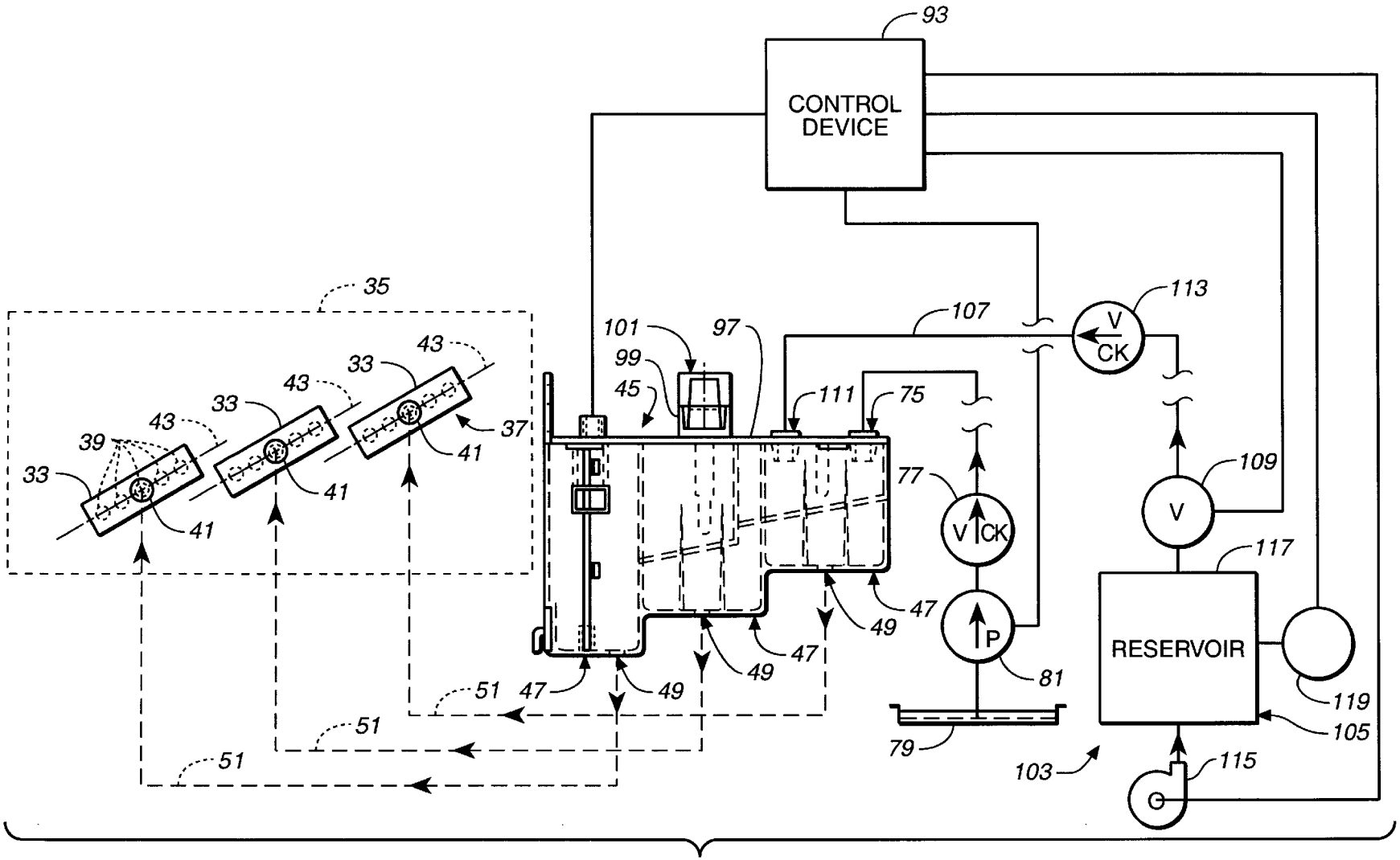
FIG. 7 schematically shows portions of an ink jet printer apparatus according to an embodiment of the present invention.

As seen in FIG. 7, each printer head 33 is preferably a piezoelectric printer head preferably having plurality of nozzles 39, at least one nozzle and preferably 128 individually controllable nozzles, formed by a laser and an inlet 41 for ink. The nozzles 39 on each printer head 33 are preferably disposed along or proximate a common center line 43 of the printer head and are preferably equally spaced relative to each other. A presently preferred printer head is manufactured by MIT Ink Jet, Stockholm, Sweden.

As seen with reference to FIGS. 3–5, the printer heads 33 are preferably discretely mounted on the alignment plate 35 in a vertically offset or staggered fashion. A centerpoint of a printer head 33 on the right side of the alignment plate 35 is preferably the same distance higher than a centerpoint of a center printer head that the centerpoint of the center printer head is higher than a centerpoint of the printer head on the left side of the alignment plate.

The printer heads 33 preferably print when the carriage 21 travels in a left-to-right direction on the track 27 and also in a right-to-left direction so that, for each 0.62 inches or 0.41 inches (15.75 mm or 10.04 mm) of printed matter, the three printer heads corresponding to a single color pass over the printing area six times. By arranging the printer heads 33 in a staggered manner, the three printer heads 33 perform three separate, successive back and forth printing operations on the same area of the web 29 and facilitate production of higher quality print jobs than are produced by conventional ink jet printers that typically have one print head per color, print in one direction only, and print an area with a color in only one pass.

As seen in FIGS. 5 and 8, the printer heads 33 are also preferably mounted on the alignment plate 35 such that the common center line 43 along which the nozzles 39 are disposed is at an angle relative to a line parallel to a direction of travel of the web 29 and perpendicular to the track 27 to obtain an optimum dots per inch (dpi) resolution for the intended operational speed of the carriage 21 relative to the web 29. A presently preferred orientation of the printer head provides approximately 300 dpi.

As seen in FIG. 7, showing an arrangement for a single, typical printer head arrangement 37 and a corresponding ink reservoir arrangement 45, each printer head arrangement is fed with ink from a corresponding ink reservoir arrangement also mounted on the movable carriage 21 behind the printer head arrangement. The ink reservoir arrangement 45 includes one or more ink reservoirs 47, equal in number to the number of printer heads 33, each one of the ink reservoirs corresponding to one of the printer heads. Each ink reservoir 47 has an outlet 49 from which ink is fed through a conduit 51 to the inlet 41 of the corresponding printer head 33.

As seen in FIG. 4, the outlet 49 of each ink reservoir 47 and the inlet 41 of the corresponding printer head 33 are preferably disposed along an axis 53 extending perpendicular to the axis 55 of the track 27. The ink reservoir arrangement 45 is preferably pivotably mounted on a frame 57 of the carriage 21 so that a worker can easily gain access to the printer heads 33 for replacement or other maintenance. The conduits 51 extending between corresponding ink reservoirs 47 and printer heads 33 preferably extend from the outlet 49 of each reservoir to a point proximate the pivot point 59 around which the ink reservoir arrangements 45 pivot and back to the inlet 41 of the corresponding printer head 33. By positioning the outlet 49 of each ink reservoir 47 and the inlet 41 of the corresponding printer head 33 so that they are disposed along the axis 53 extending perpendicular to the axis 55 of the track 27, when the carriage 21 reverses direction, ink in the portion of the conduit 51 between the pivot point 59 between the frame 57 and the alignment plate 35 and the inlet of the printer head will not tend to surge due to the inertia of the ink when direction is changed, which could cause leakage out of or air ingestion into the nozzles 39 of the printer head, because a substantially equal amount of ink surges in an offsetting direction in the portion of the conduit between the pivot point and the outlet of the ink reservoir.

As seen in FIG. 3, each ink reservoir 47 preferably contains ink to a level 61 at a first point along an axis 63 extending perpendicular to the axes 53 and 55. A centerpoint 65 of the nozzles 39 of the corresponding printer head 33 is preferably disposed at a second point along the axis 63 that is vertically no lower than the first point, and preferably between 20 and 25 mm higher than the first point. By locating the second point higher than the first point, a negative pressure at the openings of the nozzles 39 is ensured so that, after ink is sprayed from the nozzles, the ink will tend to be drawn back inside of the nozzles, thereby minimizing the possibility of leakage or air ingestion. Provided that the nozzles 39 are of sufficiently small dimension, the ink does not flow back all the way to the ink reservoir because of surface tension of the ink in the nozzle, and a concave meniscus is formed in the ink at the outlet of the nozzle.

Figure 8B:
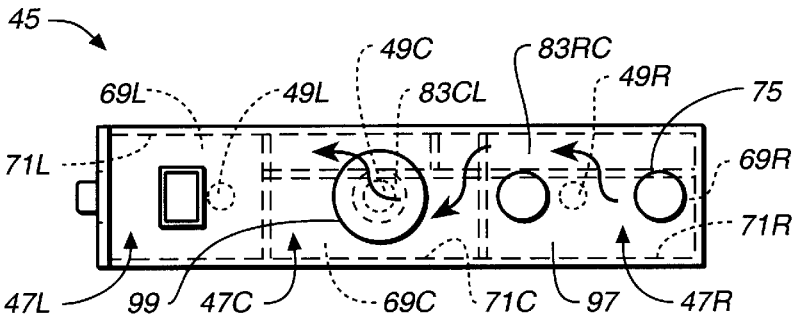
FIGS. 8A–8C are front, side, and top plan views of an ink reservoir according to an embodiment of the present invention.
Figure 8C:
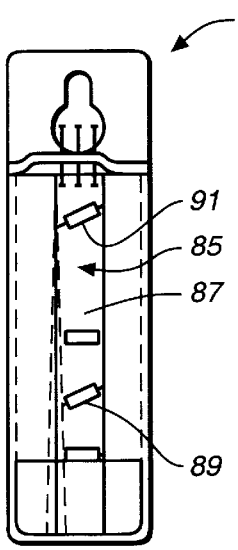
Figure 8A:
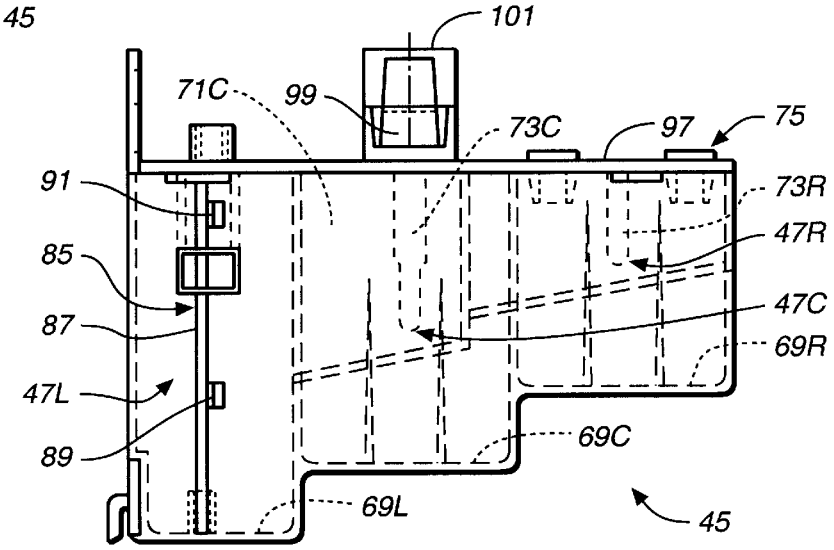

In an ink reservoir arrangement 45, each ink reservoir 47 of the three ink reservoirs corresponding to the three printer heads 33 is connected to each other ink reservoir of the three ink reservoirs. As seen in FIGS. 8A–8C, the ink reservoir 47R on the right side of the ink reservoir arrangement has a bottom wall 69R and four side walls 71R. One of the side walls 71R of the ink reservoir 47R has an opening 73R therein. The bottom wall of the ink reservoir 47R has an ink outlet opening 49R therein.

The center ink reservoir 47C and the left ink reservoir 47L have bottom wall 69C and 69L, respectively, and side walls 71C and 71L, respectively, and each of the bottom walls have a respective ink outlet opening 49C and 49L therein. An opening 75 is provided in the right ink reservoir 47R for filling ink into the first ink reservoir through a conduit 77 from an ink source 79 by means of a pump 81, as seen in FIG. 7. The opening 73R (FIG. 8A) in the side wall 71R of the right ink reservoir 47R permits fluid flow from the right ink reservoir to the center ink reservoir 47C by acting as a weir when the ink reaches the ink level desired for the right ink reservoir, the ink preferably flowing over the side wall through the opening and preferably traveling through a channel 83RC (FIG. 8B) to the center ink reservoir.

A similar opening 73C (FIG. 8A) provided in the side wall 71C of the center ink reservoir 47C permits fluid flow to the left ink reservoir 47L, preferably through a channel 83CL (FIG. 8B). The height of the opening 73R is above the height of the opening 73C, and the bottom walls 69R, 69C, and 69L of the ink reservoirs are preferably at different heights in the same manner that the centerpoints 65 of the nozzles 39 of the printer heads 33 are at different heights. Thus, by filling the ink reservoir arrangement 45 through a single opening 75 and permitting the ink to fill the ink reservoirs 47R and 47C and cascade over their respective walls 71R and 71C, the ink reservoirs are all filled to their intended ink levels.

As seen in FIGS. 7 and 8A–8C, an ink level sensor 85 is preferably disposed in the ink reservoir 47L to shut off flow of ink from the ink source 79, such as by stopping the pump 81, when the ink level in that ink reservoir reaches a predetermined ink level. The ink level sensor 85 is preferably a printed circuit board 87 on which two thermistors 89 and 91 are mounted at different levels and through which an electric current is passed. The upper one of the thermistors 91 is preferably disposed near the top of the ink reservoir 47L and the lower one of the thermistors 89 is disposed at the desired ink level for the reservoir. When ink is filled into the ink reservoir arrangement 45 and the ink in the left ink reservoir 47L reaches the thermistor 89 at the desired ink level, the change in the resistance of the thermistor is detected by a control device 93 and a signal is sent to the pump 81 to stop pumping, or a signal is sent to a valve, if provided, in the conduit 77 to shut off flow to the ink reservoir arrangement, or both. A check valve 95 is preferably provided in the conduit 77.

The ink reservoir arrangement 45 is preferably a molded plastic part with a removable top 97. A vent hole 99 is preferably provided in the top 97 of the ink reservoir arrangement 45 to prevent a vacuum from being created in the ink reservoirs 47 as ink is withdrawn from the reservoirs and into the printer heads 33 as it is sprayed out of the nozzles 39. An air permeable plug 101 is preferably disposed in the vent hole 99. The plug 101 preferably provides sufficient resistance to fluid pressure against the plug such that, in the event of malfunction of the level sensor 85 such that ink should overflow, when pressurized fluid urges against the plug, the fluid tends to flow out of the nozzles 39 of the printer heads 33 instead of out of the vent hole 99, thereby reducing the possibility of getting ink over control electronics mounted on the carriage 21.

As seen in FIG. 7, a purging arrangement 103 is preferably provided for purging the nozzles 39 of the printer heads 33. The purging arrangement 103 preferably includes a source 105 of pressurized gas, a conduit 107 in communication between the source of pressurized gas and the ink reservoir arrangement 45, and a valve 109 disposed between the source of pressurized gas and the ink reservoir arrangement for opening and closing communication between the source of pressurized gas and the ink reservoir arrangement.

The conduit 107 preferably is connected to a purging gas inlet opening 111 on the top 97 of the ink reservoir arrangement 45. By providing pressurized gas from the source 105 of pressurized gas through the conduit 107 to the ink reservoir arrangement 45, because all of the ink reservoirs 47 are in communication with one another, the pressurized gas quickly creates a high pressure above the ink in the reservoirs which is not completely relieved by the air permeable plug 99 and ink is blown out of all of the nozzles 39 in the pressure head. A one-way or check valve 113 is preferably also provided in the conduit 107 for preventing communication from the ink reservoir arrangement 45 to the source 105 of pressurized gas so that ink overflows do not damage the purging arrangement 103 or associated control electronics.

The source 105 of pressurized gas preferably includes a compressor 115, a reservoir 117 for the pressurized gas, and a pressure sensitive switch 119 in the reservoir for turning the compressor on and off when the pressure in the reservoir falls below or rises above a predetermined pressure. The reservoir 117 is preferably maintained at a pressure of approximately 15 psi (103420 Pa) above atmospheric pressure.

The control device 93 preferably controls the purging arrangement 103, the ink supply to the reservoir arrangement 45, and the firing of individual ones of the nozzles 39 of the printer heads 33. The pump 81 is preferably controlled by the control device 93 to begin and stop flow of ink from the source of ink 79 when the ink level sensor 85 detects that a low and a sufficient ink level, respectively, exists in the reservoir arrangement 45. The control device 93 can also be used to open and shut a valve in the conduit 77 leading to the opening for filling ink 75 in the reservoir arrangement 45, if the valve is provided, when a low and a sufficient ink level, respectively, exists in the reservoir arrangement.

The control device 93 preferably controls the operation of the purging arrangement 103 by turning on and off the compressor 115 in response to a pressure sensed by the pressure sensitive switch 119 that sends a signal to the control device either when the pressure in the reservoir 117 is below or above a predetermined pressure, or both. The control device 93 preferably counts a number of times that the individual nozzles 39 of the printer heads 33 fire and, after any one of the nozzles fires a predetermined number of times, such as ninety million times, causes the printer carriage 21 to automatically move to a maintenance station. When the printer carriage 21 is at the maintenance station, the control device 93 causes the valve 109 to open so that pressurized gas in the reservoir 117 flows through the conduit 107 to the reservoir arrangement 45 and creates a high pressure on the ink in the reservoir, the pressure causing the ink to be forced out of the nozzles 39 in the printer heads 33 to purge the nozzles. A suitable maintenance station is disclosed in commonly-assigned U.S. patent application Ser. No. 08/815,591, filed on Mar. 12, 1997 entitled Maintenance Station and Capping Station for a Printing Device.

Ink may be supplied from the ink source 79 to the reservoir arrangement 45 while the printer head carriage 21 is in motion and the printer heads 33 are printing. This can be accomplished because there are no surge pressures in the conduits 51 between the printer heads 33 and the ink reservoir arrangement by virtue of the arrangement of the printer heads in line with their respective ink reservoirs 47R, 47C, 47L and because of the provision of the vent hole 99 with the air permeable plug 101 that prevents the ink that is supplied from generating excessive pressure in the reservoir arrangement.

It is, of course, possible to embody the invention in specific forms other than those described above without departing from the spirit of the present invention. The embodiments shown are merely illustrative and should not be considered restrictive in any way. The scope of the present invention is given in the appended claims, rather than the preceding description, and all variations and equivalents which fall within the range of the claims are intended to be embraced therein.

What is claimed is:

1. An apparatus for supplying ink to a printer head arrangement mounted on a movable carriage, comprising:

a track extending along a first axis;

a carriage mounted on the track and movable along the track in a positive and negative direction along the first axis;

a printer head arrangement mounted on the movable carriage, the printer head arrangement including one or more printer heads, each printer head of the one or more printer heads including an inlet and at least one nozzle;

an ink reservoir arrangement pivotally mounted on the movable carriage behind the printer head arrangement and movable relative to the printer head arrangement, the ink reservoir arrangement including one or more ink reservoirs, each ink reservoir of the one or more ink reservoirs having an outlet;

one or more conduits, each of the one or more conduits connecting the outlet of a corresponding one of the one or more ink reservoirs to the inlet of a corresponding one of the one or more printer heads;

wherein, for each corresponding ink reservoir and printer head, the outlet of the ink reservoir and the inlet of the printer head are disposed along a second axis extending perpendicular to the first axis.

2. The apparatus as set forth in claim 1, wherein for each corresponding ink reservoir and printer head, the ink reservoir contains ink at a first level along a third axis extending perpendicular to the first and second axis and the nozzle of the printer head is disposed at a second level along the third axis that is vertically no lower than the first level.

3. The apparatus as set forth in claim 1, wherein the one or more printer heads of the printer head arrangement includes a plurality of printer heads, and the one or more ink reservoirs of the ink reservoir arrangement includes a plurality of ink reservoirs, each of the plurality of ink reservoirs corresponding to one of the plurality of printer heads, each of the plurality of ink reservoirs being connected to a corresponding one of the plurality of printer heads by a conduit of the one or more conduits.

4. The apparatus as set forth in claim 3, wherein each printer head of the plurality of printer heads is mounted on the carriage discretely from each other printer head of the plurality of printer heads.

5. The apparatus as set forth in claim 4, wherein each ink reservoir of the plurality of ink reservoirs is connected to each other ink reservoir of the plurality of ink reservoirs.

6. The apparatus as set forth in claim 5, further comprising a source of ink disposed at a point remote from the carriage and connected to the ink reservoir arrangement by a conduit.

7. An apparatus for supplying ink to a printer head arrangement mounted on a movable carriage, comprising:

a track extending along a first axis;

a carriage mounted on the track and movable along the track in a positive and negative direction along the first axis;

a printer head arrangement mounted on the movable carriage, the printer head arrangement including one or more printer heads, each printer head of the one or more printer heads including an inlet and at least one nozzle;

an ink reservoir arrangement mounted on the movable carriage behind the printer head arrangement, the ink reservoir arrangement including one or more ink reservoirs, each ink reservoir of the one or more ink reservoirs having an outlet;

one or more conduits, each of the one or more conduits connecting the outlet of a corresponding one of the one or more ink reservoirs to the inlet of a corresponding one of the one or more printer heads;

wherein, for each corresponding ink reservoir and printer head, the outlet of the ink reservoir and the inlet of the printer head are disposed along a second axis extending perpendicular to the first axis, the one or more printer heads of the printer head arrangement includes a plurality of printer heads, and the one or more ink reservoirs of the ink reservoir arrangement includes a plurality of ink reservoirs, each of the plurality of ink reservoirs corresponding to one of the plurality of printer heads, each of the plurality of ink reservoirs being connected to a corresponding one of the plurality of printer heads by a conduit of the one or more conduits, each printer head of the plurality of printer heads is mounted on the carriage discretely from each other printer head of the plurality of printer heads, each ink reservoir of the plurality of ink reservoirs is connected to each other ink reservoir of the plurality of ink reservoirs, and each of the plurality of ink reservoirs of the ink reservoir arrangement are each filled with ink to different ink levels along a third axis perpendicular to the first and second axes.

8. The apparatus as set forth in claim 7, wherein nozzles of each of the plurality of printer heads are disposed at different levels along the third axis than one another.

9. The apparatus as set forth in claim 8, further comprising a source of ink disposed at a point remote from the carriage and connected to a first ink reservoir of the plurality of ink reservoirs having an ink level higher than any other one of the ink reservoirs of the plurality of ink reservoirs, and a pump connected to the source of ink and the first ink reservoir to pump ink from the source of ink to the first ink reservoir.

10. The apparatus as set forth in claim 9, wherein the ink reservoirs are connected to one another such that, when the first reservoir is filled to its ink level, ink flows from the first ink reservoir to each other one of the ink reservoirs to fill each other one of the ink reservoirs to their ink levels.

11. The apparatus as set forth in claim 10, further comprising an ink level sensor disposed in a second ink reservoir of the plurality of ink reservoirs, the ink level sensor being connected to the pump and being adapted to start and stop the pump, the second ink reservoir having an ink level lower than any other one of the ink reservoirs of the plurality of ink reservoirs, the ink level sensor sensing when the second ink reservoir is filled to its ink level and stopping the pump from pumping ink to the first ink reservoir.

12. The apparatus as set forth in claim 1, further comprising a source of ink disposed at a point remote from the carriage and connected to the one or more ink reservoirs, a pump connected to the source of ink and the one or more ink reservoirs to pump ink from the source of ink to the one or more ink reservoirs, and an ink level sensor disposed in at least one of the one or more ink reservoirs, the ink level sensor being connected to the pump and being adapted to start and stop the pump, the ink level sensor sensing when the at least one ink reservoir is filled to a predetermined ink level and stopping the pump from pumping ink to the one or more ink reservoirs.

13. The apparatus as set forth in claim 12, further comprising a vent hole in a top of the ink reservoir arrangement.

14. The apparatus as set forth in claim 13, further comprising an air permeable plug disposed in the vent hole, the plug providing sufficient resistance to fluid pressure against the plug such that, when pressurized fluid urges against the plug, fluid tends to flow out of the nozzle of the printer head instead of out of the vent hole.

15. The apparatus set forth in claim 1, wherein the outlet of the ink reservoir and the inlet of the printer head are disposed along the second axis when the ink reservoir arrangement is in an operating position and wherein the ink reservoir arrangement is pivotable to an access position in which the inlet of the printer head is disposed along the second axis and the outlet of the ink reservoir is removed from the second axis and the printer head is accessible by an operator.

16. The apparatus as set forth in claim 1, further comprising a purging arrangement for purging ink from the nozzle of each printer head of the printer head arrangement.

17. The apparatus as set forth in claim 16, wherein the purging arrangement comprises a source of pressurized gas, a conduit in communication between the source of pressurized gas and the ink reservoir arrangement, and a valve connected between the source of pressurized gas and the ink reservoir arrangement for opening and closing communication between the source of pressurized gas and the ink reservoir arrangement.

18. The apparatus as set forth in claim 17, further comprising a one-way valve in the conduit for preventing communication from the ink reservoir arrangement to the source of pressurized gas.

19. The apparatus as set forth in claim 1, further comprising a plurality of printer head arrangements substantially identical to the printer head arrangement, a plurality of ink reservoir arrangements substantially identical to the ink reservoir arrangement, each one of the plurality of printer head arrangements corresponding to one of the plurality of ink reservoir arrangements, and each corresponding printer head arrangement and ink reservoir arrangement of the plurality of printer head arrangements and ink reservoir arrangements being mounted on the carriage at different levels along a third axis extending perpendicularly to the first and second axes from one another and from the printer head arrangement.

20. The apparatus as set forth in claim 19, wherein each corresponding printer head arrangement and ink reservoir arrangement corresponds to a single ink color.

21. The apparatus set forth in claim 7, wherein the outlet of the ink reservoir and the inlet of the printer head are disposed along the second axis when the ink reservoir arrangement is in an operating position and wherein the ink reservoir arrangement is pivotable to an access position in which the inlet of the printer head is disposed along the second axis and the outlet of the ink reservoir is removed from the second axis and the printer head is accessible by an operator.

22. A carriage for an ink jet printer arrangement, comprising:

a plate and a frame mounted to the plate;

a printer head arrangement mounted on the plate, the printer head arrangement including one or more printer heads, each printer head of the one or more printer heads including an inlet and at least one nozzle;

an ink reservoir arrangement pivotally mounted on the frame, the ink reservoir arrangement including one or more ink reservoirs, each ink reservoir of the one or more ink reservoirs having an outlet;

one or more conduits, each of the one or more conduits connecting the outlet of a corresponding one of the one or more ink reservoirs to the inlet of a corresponding one of the one or more printer heads.

23. The carriage as set forth in claim 22, wherein the carriage includes means for mounting the carriage on a track, the track having a first axis, and the outlet of each ink reservoir and the inlet of the corresponding printer head are disposed along a second axis extending perpendicular to the first axis.

24. The carriage set forth in claim 22, wherein the ink reservoir arrangement is pivotable between an operating position and an access position, inlets of each of the one or more printer head being closer to outlets of the one or more ink reservoir when the ink reservoir is pivoted to the operating position than when the ink reservoir is pivoted to the access position.

* * * * *